US007475680B2

(12) United States Patent
Roche et al.

(10) Patent No.: US 7,475,680 B2
(45) Date of Patent: Jan. 13, 2009

(54) INTEGRATED LIQUID-GAS SEPARATOR AND RESERVOIR

(75) Inventors: Bradley Jon Roche, Cass City, MI (US); Travis DePriest, Roseau, MN (US)

(73) Assignee: Polaris Industries Inc., Medina, MN (US)

( * ) Notice: Subject to any disclaimer, the term of this patent is extended or adjusted under 35 U.S.C. 154(b) by 60 days.

(21) Appl. No.: 11/099,805

(22) Filed: Apr. 6, 2005

(65) Prior Publication Data

US 2006/0226155 A1 Oct. 12, 2006

(51) Int. Cl.
*F02B 25/06* (2006.01)

(52) U.S. Cl. ..... 123/572

(58) Field of Classification Search ..... 123/572–574, 123/41.86

See application file for complete search history.

(56) References Cited

U.S. PATENT DOCUMENTS 4,269,607 A 5/1981 Walker
4,453,525 A * 6/1984 DeBruler ..... 123/573
4,528,969 A 7/1985 Senga
4,569,323 A 2/1986 Okumura
4,627,406 A 12/1986 Namiki et al.
4,766,860 A 8/1988 Abe et al.
4,790,287 A 12/1988 Sakurai et al.
5,094,638 A 3/1992 Kobayashi
5,239,972 A 8/1993 Takeyama et al.
5,450,835 A * 9/1995 Wagner ..... 123/573
5,562,087 A * 10/1996 Wright ..... 123/572
5,564,401 A * 10/1996 Dickson ..... 123/573
5,586,996 A 12/1996 Manookian, Jr.
5,839,930 A 11/1998 Nanami et al.
5,879,211 A 3/1999 Koyanagi
5,899,779 A 5/1999 Hattori
5,951,342 A 9/1999 Ozawa et al.
5,951,343 A 9/1999 Nanami et al.
6,015,320 A 1/2000 Nanami
6,058,917 A * 5/2000 Knowles ..... 123/573
6,161,529 A * 12/2000 Burgess ..... 123/572
6,247,442 B1 6/2001 Bedard et al.
6,279,556 B1 8/2001 Busen et al.
6,345,614 B1 2/2002 Shureb
6,415,459 B1 7/2002 Sevier
6,415,759 B2 7/2002 Ohrnberger et al.
6,447,351 B1 9/2002 Nanami
6,464,033 B2 10/2002 Izumi et al.
6,475,046 B2 11/2002 Muramatsu et al.
6,537,115 B2 3/2003 Suganuma et al.
6,544,084 B1 4/2003 Nanami
6,551,153 B1 4/2003 Hattori
6,561,297 B2 5/2003 Yatagai et al.

(Continued)

OTHER PUBLICATIONS

Nick Ferraro, "A Clean Contest," Snowmobile Magazine, p. 40-41, Spring 2001.

*Primary Examiner*—M. McMahon
(74) *Attorney, Agent, or Firm*—Baker & Daniels LLP

(57) ABSTRACT

Embodiments of the invention include a vehicle comprising a chassis, an engine supported by the chassis, the engine coupled to a drive train useful for propelling the vehicle, and a seat supported by the chassis, a liquid reservoir separate from the engine, and a separator useful for separating liquid and gas disposed within the liquid reservoir. Embodiments of the invention also include methods of separating liquid and gas.

62 Claims, 15 Drawing Sheets

U.S. PATENT DOCUMENTS 6,626,163 B1 9/2003 Busen et al.
6,695,658 B1 * 2/2004 Muramatsu ..... 440/88 L
6,783,571 B2 * 8/2004 Ekeroth ..... 95/8
6,848,529 B2 2/2005 Moriyama
7,007,682 B2 * 3/2006 Takahashi et al. ..... 123/572
2002/0083934 A1 7/2002 Ruehlow et al.
2003/0045187 A1 3/2003 Matsuda et al.
2004/0069287 A1 4/2004 Matsuda et al.

* cited by examiner

9(a)

9(e)

9(b)

9(d)

9(c)

INTEGRATED LIQUID-GAS SEPARATOR AND RESERVOIR

FIELD OF THE INVENTION

Embodiments of the invention generally relate to integrated liquid-gas separators and reservoirs.

BACKGROUND OF THE INVENTION

Typically, dry sump oiling systems have five separate major components. These components include a pressure pump, a scavenge pump, an oil and gas separator, an oil reservoir, and a vapor separator. In many traditional systems, the pressure pump takes oil from the oil reservoir, pressurizes it, and forces it through the oil passages in the engine. The scavenge pump transports oil and gas from the crankcase to the oil and gas separator. The ratio of gas (e.g., air) to oil in the scavenged mixture is called the scavenge ratio. The oil and gas separator separates the scavenged oil and gas mixture into gas, which is vented to the vapor separator, and liquid oil, which is transported to the separate oil reservoir. The oil reservoir supplies oil to the pressure pump. The vapor separator allows the air, fuel vapor, and water vapor in the vented gases from the oil and gas separator to be transported to the engine's intake system and oil droplets to be transferred to the engine crankcase.

Therefore, traditional dry-sump systems use a separate oil reservoir and oil and gas separator. Separate oil reservoirs of this type are mostly static, meaning they have a low velocity supply of pure oil into the reservoir and a low velocity exit of oil from the reservoir. Hence, ensuring that a vehicle with such a system can operate at desired angles while prohibiting gases from discharging with the liquid oil and liquid oil from discharging with the gases is relatively straightforward.

BRIEF SUMMARY OF THE INVENTION

Embodiments of the invention include a vehicle comprising a chassis, an engine supported by the chassis, the engine coupled to a drive train useful for propelling the vehicle, and a seat supported by the chassis, a liquid (e.g., oil) reservoir separate from the engine, and a separator useful for separating liquid and gas disposed within the liquid reservoir. In some embodiments, the separator is generally disposed to include the center of a horizontal cross section of the liquid reservoir. Some embodiments also include a separator with a guiding member adapted to separate gas from liquid. Further, some embodiments are adapted to achieve relatively extreme operating angles. In addition, some embodiments are adapted to deliver liquid and gas proximate a center of the horizontal cross section of the reservoir. Embodiments of the invention also include methods of separating liquid and gas.

Such an integrated liquid separator and reservoir is adapted to reduce venting liquid with gas, even at relatively extreme operating angles. Further, such a system is adapted to save space within the engine compartment and allow for greater flexibility in placing engine components.

BRIEF DESCRIPTION OF THE DRAWINGS

FIG. 8(*b*) shows a side plan view of a gas chamber in accordance with an embodiment of the invention.

FIG. 8(*c*) shows a top plan view of a gas chamber in accordance with an embodiment of the invention.

FIG. 8(*d*) shows a side plan view of a gas chamber in accordance with an embodiment of the invention.

FIG. 8(*e*) shows a perspective view of a gas chamber in accordance with an embodiment of the invention.

FIG. 8(*f*) shows a rear plan view of a gas chamber in accordance with an embodiment of the invention.

FIG. 9(*b*) shows a top plan view of a liquid chamber in accordance with an embodiment of the invention.

FIG. 9(*c*) shows a side plan view of a liquid chamber in accordance with an embodiment of the invention.

FIG. 9(*d*) shows a front plan view of a liquid chamber in accordance with an embodiment of the invention.

FIG. 9(*e*) shows a perspective view of a liquid chamber in accordance with an embodiment of the invention.

FIG. 10(*b*) shows a bottom plan view of a separator in accordance with an embodiment of the invention.

FIG. 10(*c*) shows a top plan view of a separator in accordance with an embodiment of the invention.

FIG. 10(*d*) shows a front plan view of a separator in accordance with an embodiment of the invention.

FIG. 10(*e*) shows a perspective view of a separator in accordance with an embodiment of the invention.

FIG. 10(*f*) shows a side plan view of a separator in accordance with an embodiment of the invention.

FIG. 11(*b*) shows a perspective view of a separator and deflector in accordance with an embodiment of the invention.

FIG. 12(*b*) shows a top plan view of a deflector in accordance with an embodiment of the invention.

FIG. 12(*c*) shows a front plan view of a deflector in accordance with an embodiment of the invention.

FIG. 12(*d*) shows a bottom plan view of a deflector in accordance with an embodiment of the invention.

FIG. 12(*e*) shows a side plan view of a deflector in accordance with an embodiment of the invention.

FIG. 12(*f*) shows a perspective view of a deflector in accordance with an embodiment of the invention.

FIG. 13(*b*) shows a side plan view of an inlet nozzle in accordance with an embodiment of the invention.

FIG. 13(*c*) shows a top plan view of an inlet nozzle in accordance with an embodiment of the invention.

FIG. 13(*d*) shows a perspective view of an inlet nozzle in accordance with an embodiment of the invention.

FIG. 13(*e*) shows a rear plan view of an inlet nozzle in accordance with an embodiment of the invention.

FIG. 14(*b*) shows a side plan view of an inhibiting member in accordance with an embodiment of the invention.

FIG. 14(*c*) shows a perspective view of an inhibiting member in accordance with an embodiment of the invention.

DETAILED DESCRIPTION OF THE INVENTION

The following detailed description should be read with reference to the drawings, in which like elements in different drawings are numbered identically. The drawings, which are not necessarily drawn to scale, depict selected embodiments and are not intended to limit the scope of the invention. Several forms of the embodiments will be shown and described, and other forms will be apparent to those skilled in the art. It will be understood that embodiments shown in drawings and described are merely for illustrative purposes and are not intended to limit the scope of the embodiments as defined in the claims that follow.

Figure 1:
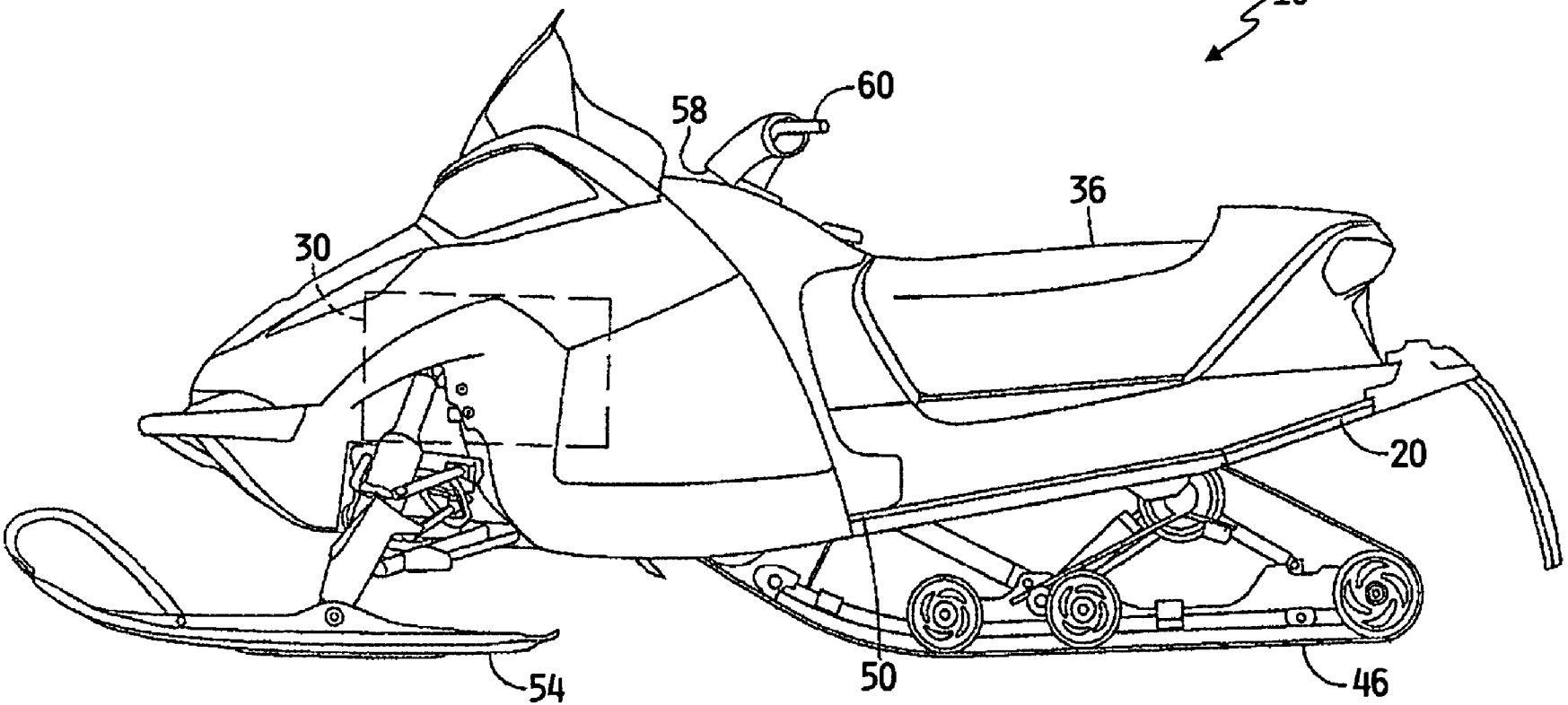
FIG. 1 shows a side plan view of a snowmobile in accordance with an embodiment of the invention.

A snowmobile 10 in accordance with an embodiment of the invention is shown in FIG. 1. Generally, snowmobile 10 includes a longitudinally extending chassis 20. The chassis 20 supports and mounts several vehicle components, including an engine 30, a seat 36 (e.g., straddle type), footrests 50, at least one ground engaging element, such as a drive track 46, or a pair of steerable skis 54. The seat 36 may be adapted to accommodate a rider in straddle fashion, and the engine 30 powers the drive track 46 operatively connected to the chassis 20. A steering post 58 is operatively connected to the pair of skis 54. Handlebars 60 to effect steering may be provided.

Figure 2:
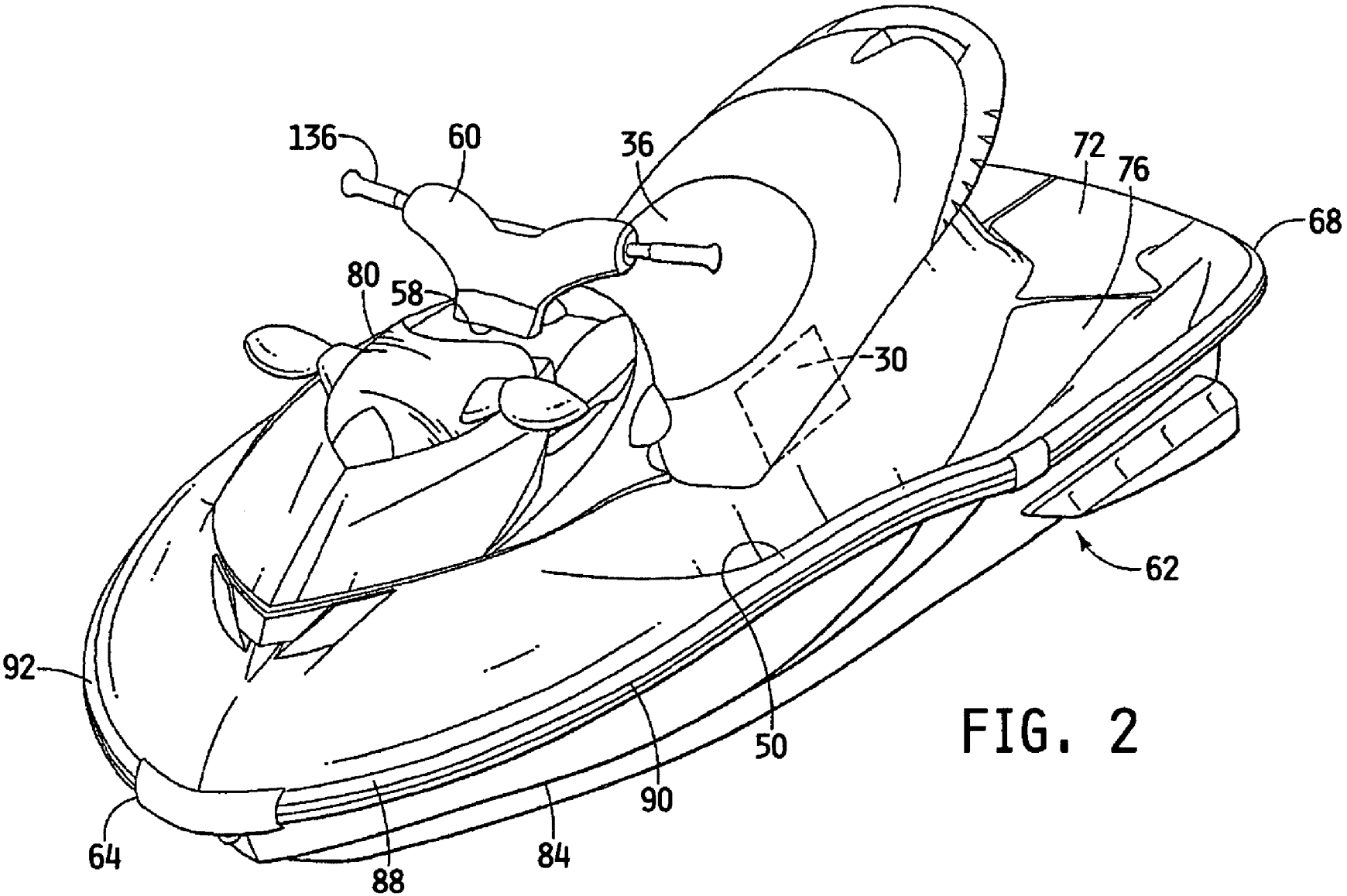
FIG. 2 shows a perspective view of a personal watercraft in accordance with an embodiment of the invention.

A watercraft 62 in accordance with an embodiment of the invention is shown in FIG. 2. Watercraft 62 has generally a front or bow 64 and a rear or stern 68 and includes an upper portion 72 that includes a top deck 76 and shroud 80. The top deck 76 is secured to a bottom hull 84 along an overlapping portion 88 covered with a rub rail 90, thereby forming a hull 92. The hull 92 can serve as a chassis 20' for mounting and supporting other watercraft vehicle components. The hull 92 formed by the bottom hull 84 and top deck 76 defines a compartment sized to house an internal combustion engine 30' for powering the watercraft 62. The deck 76 also has a raised, longitudinally extending seat 36' adapted to accommodate one or more riders. A footrest 50' area is also provided. A steering post 58' is operatively connected to a jet useful for providing steering to the watercraft 62. In this example, the jet may be considered an at least one ground engaging element. Handlebars 60' supported by the steering post 58' may be provided for rotating the steering post 58 to effect steering.

Figure 3:
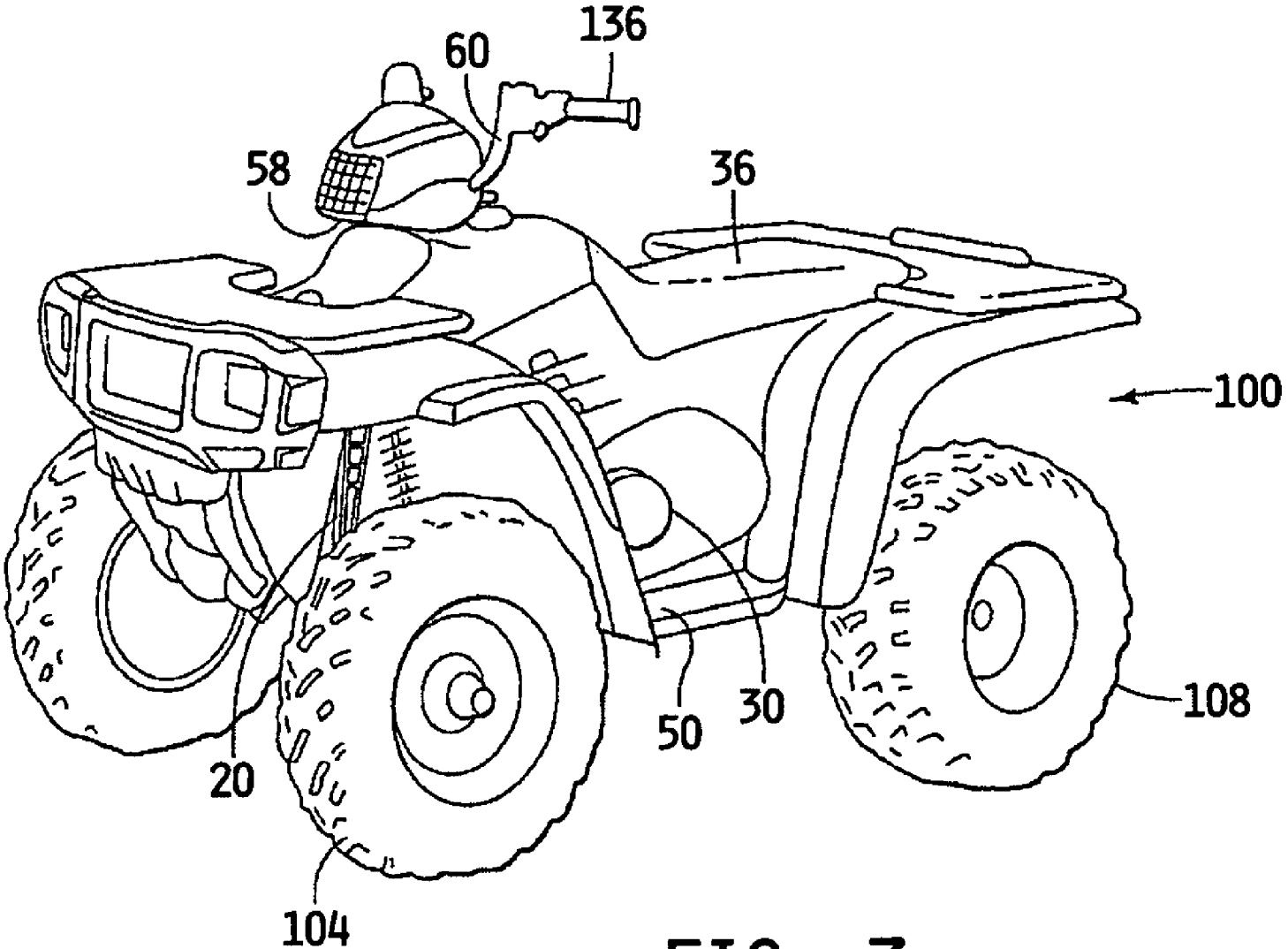
FIG. 3 shows a perspective view of an all terrain vehicle in accordance with an embodiment of the invention.

An ATV 100 in accordance with an embodiment of the invention is shown in FIG. 3. ATV 100 includes a chassis 20", at least one ground engaging element, such as two front wheels 104 and two rear wheels 108, a seat 36", laterally extending footrests 50" on opposite sides of the vehicle, and an engine 30" located generally beneath the seat 36" and substantially between the footrests 50". A steering post 58" is operatively connected to the pair of wheels 104. Handlebars 60" supported by the steering post 58" may be provided for rotating the steering post 58" to effect steering.

Figure 3A:
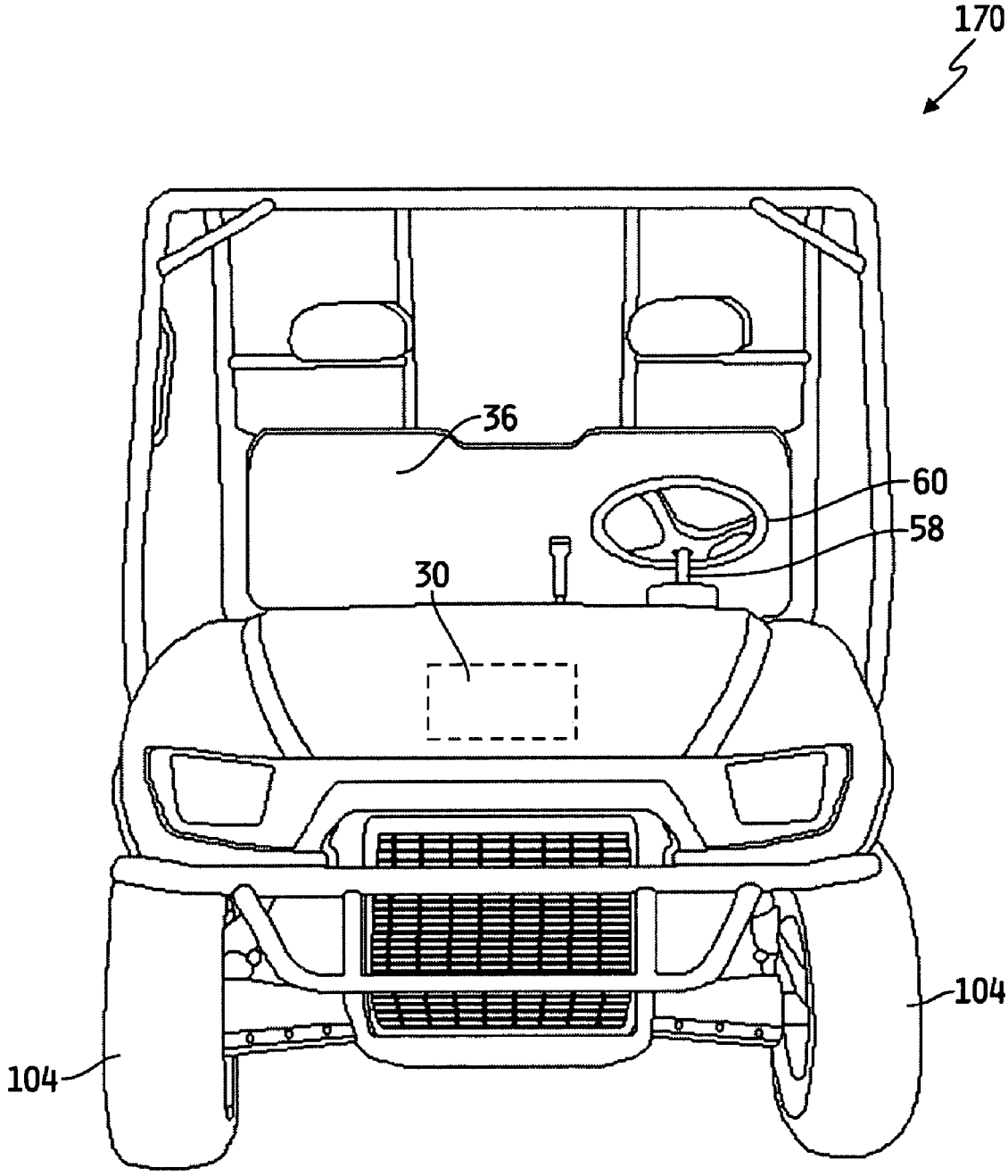
FIG. 3A shows a front view of a utility vehicle in accordance with an embodiment of the invention.

A utility vehicle 170 in accordance with an embodiment of the invention is shown in FIG. 3A. Utility vehicle 170 includes a chassis, at least one ground engaging element, such as two front wheels 104, and an engine 30" located generally forward the seat 36." A steering post 58" is operatively connected to the pair of wheels 104. Handlebars 60" (e.g., a steering wheel) supported by the steering post 58" may be provided for rotating the steering post 58" to effect steering.

Similar components on each vehicle are identified above with like names and element numbers. Distinctions between such components are indicated above with the use and non-use of one or more primes after the element number. In order to simplify the discussion hereinafter, no prime indicators are used. It is understood, however, that all references to elements defined in multiple vehicle types (e.g., chassis 20, engine 30, seat 36, footrest 50, steering post 58, handlebars 60, etc.) may apply to each of such vehicles. It is understood that the discussion may apply equally to other motorized vehicles.

Figure 4:
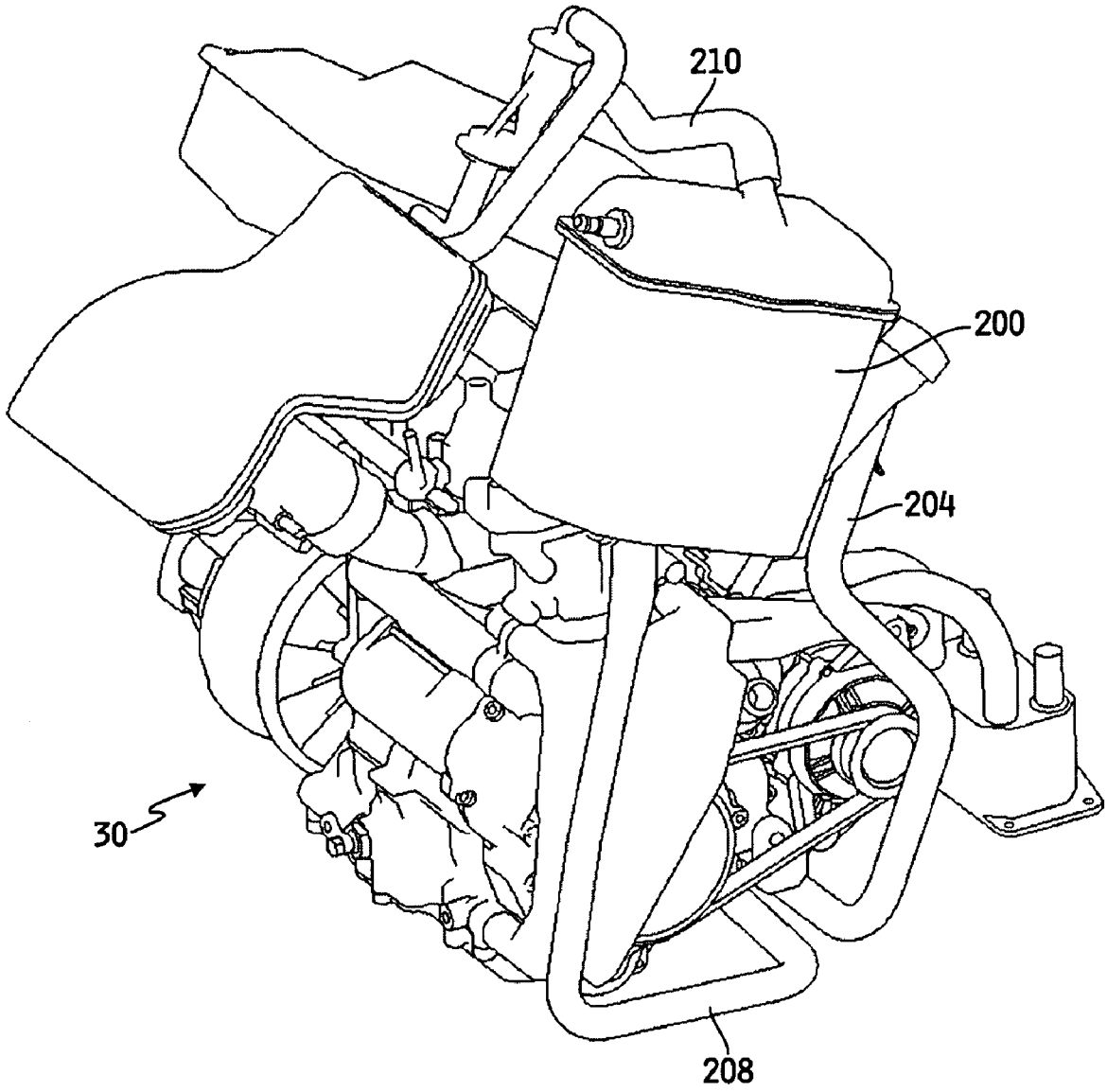
FIG. 4 shows a perspective view of an engine in accordance with an embodiment of the invention.
Figure 5:
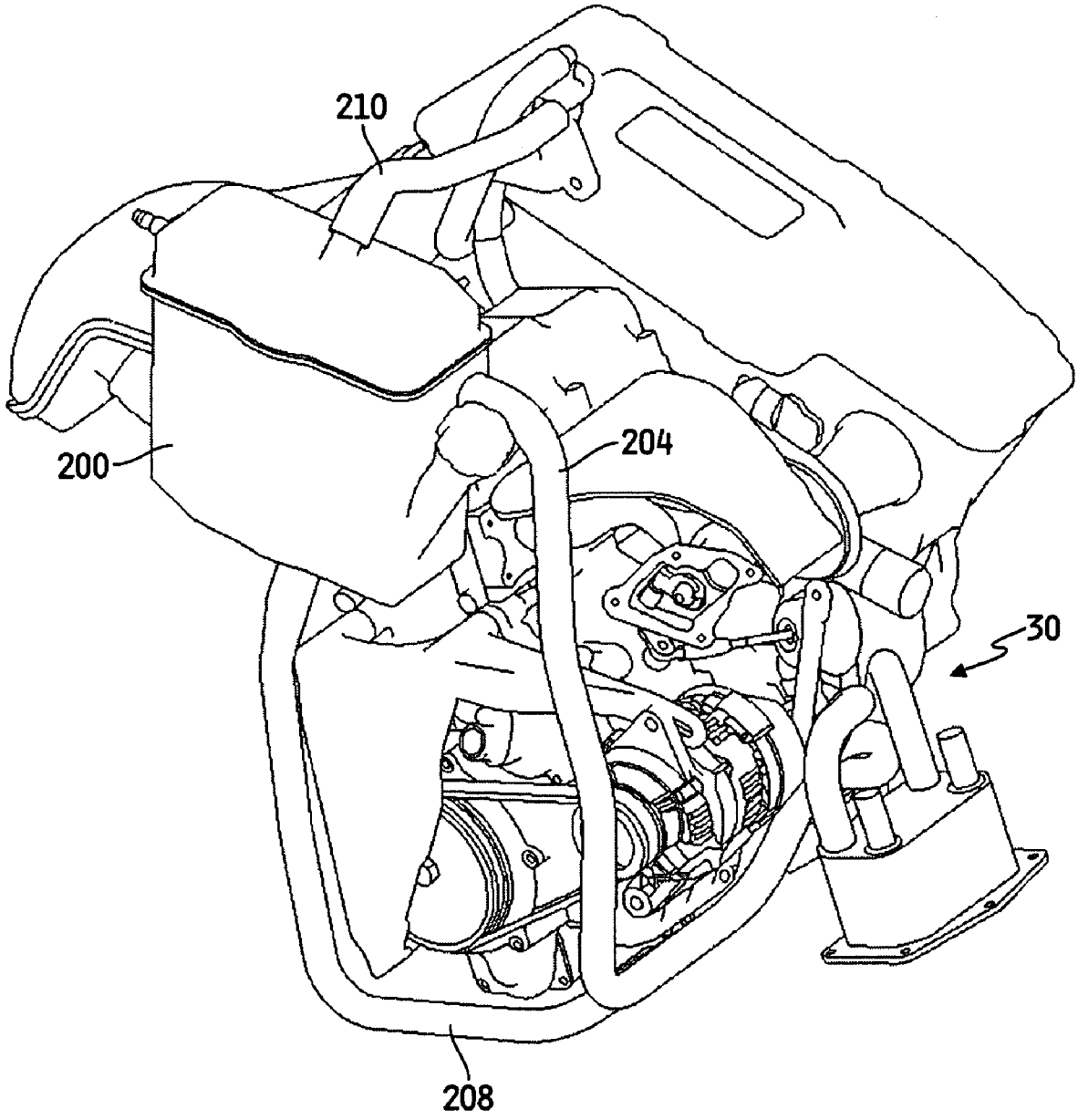
FIG. 5 shows a perspective view of an engine in accordance with an embodiment of the invention.

As shown in FIGS. 4 and 5, the engine 30 may be of the four-cycle (sometimes referred to herein as four-stroke) type. Further, engine 30 may be dry-sump lubricated and have a scavenge ratio of about 0.1:1 to about 10:1. In other embodiments, the engine 30 may have a scavenge ratio of about 5:1 to about 10:1. The engine 30 may include an intake system useful for introducing air and gas into the engine. Engine 30 may use a variety of liquids, such as oil and cooling fluid. Therefore, although the disclosure primarily discusses embodiments including oil as the liquid, it is understood that other liquids may be used with the invention. Liquid oil is used to lubricate the reciprocating motion of the pistons and other moving parts within the engine. During operation, uncombusted air and other gases may mix with the liquid lubricating oil, where they will cause performance and/or maintenance problems unless removed. The liquid oil and gas may be removed from the engine and delivered to a liquid reservoir 200 separate from the engine 30 via a scavenge pump and a delivery line 204. In some embodiments, the liquid reservoir 200 includes a separator 206 for separating the liquids from the gases. After separation, the liquid may be stored and drained from the reservoir 200 and delivered back to the engine 30 (by pump, if necessary) through line 208. Gases, such as air water vapor, and/or hydrocarbons may be discharged from the reservoir 200 and delivered back to the engine intake system though gas line 210. In some embodiments, the gases are first delivered to a vapor separator useful for separating the gas into air, water vapor, fuel, and/or liquid oil components, which may be disposed of as appropriate. For example, the air, water vapor, and fuel may be delivered to the engine intake system and the liquid oil, if any, may be combined with the liquid oil in the engine 30 and/or liquid reservoir 200.

Figure 6:
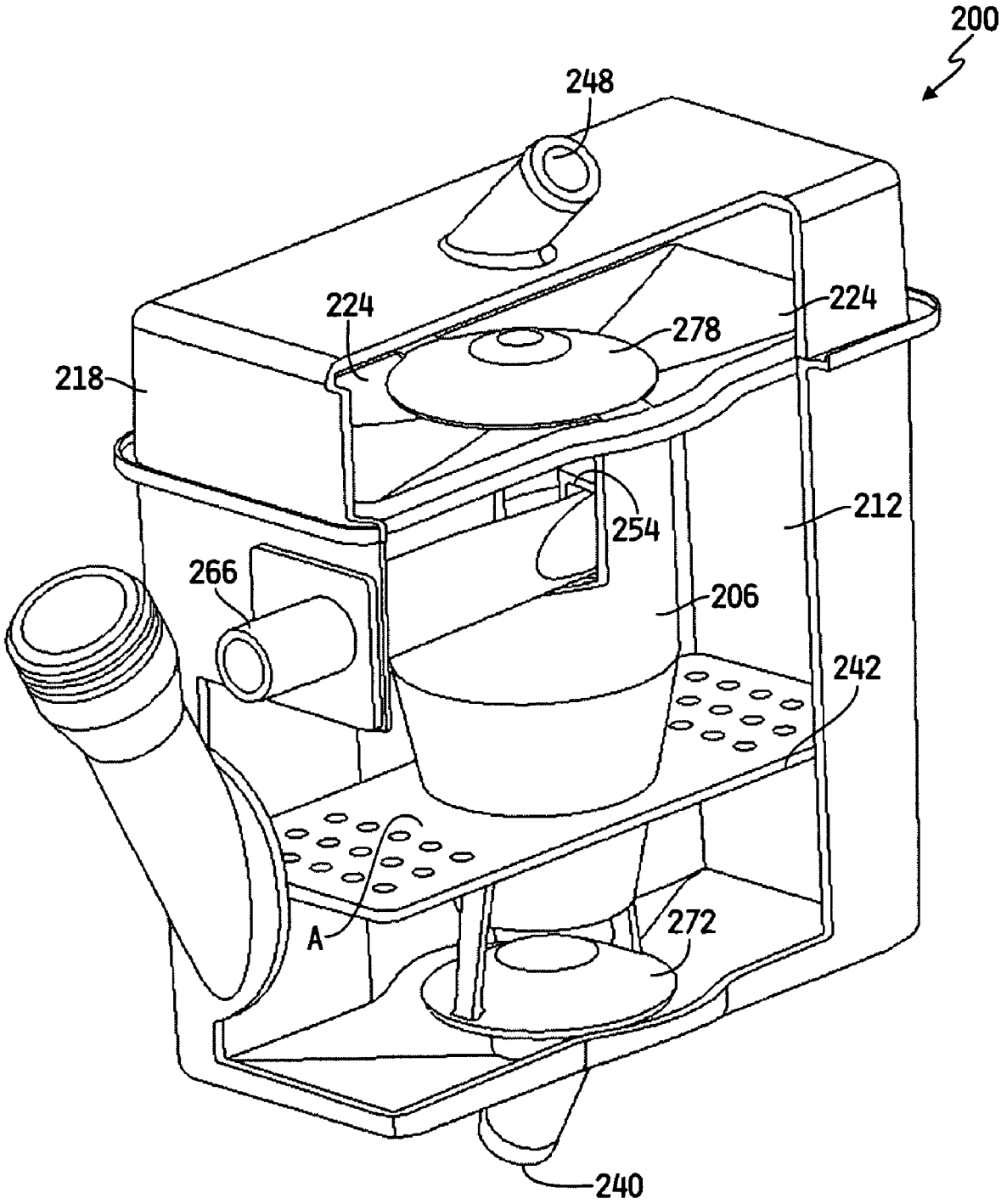
FIG. 6 shows a cut-away perspective view of an integrated liquid reservoir and separator in accordance with an embodiment of the invention.
Figure 7:
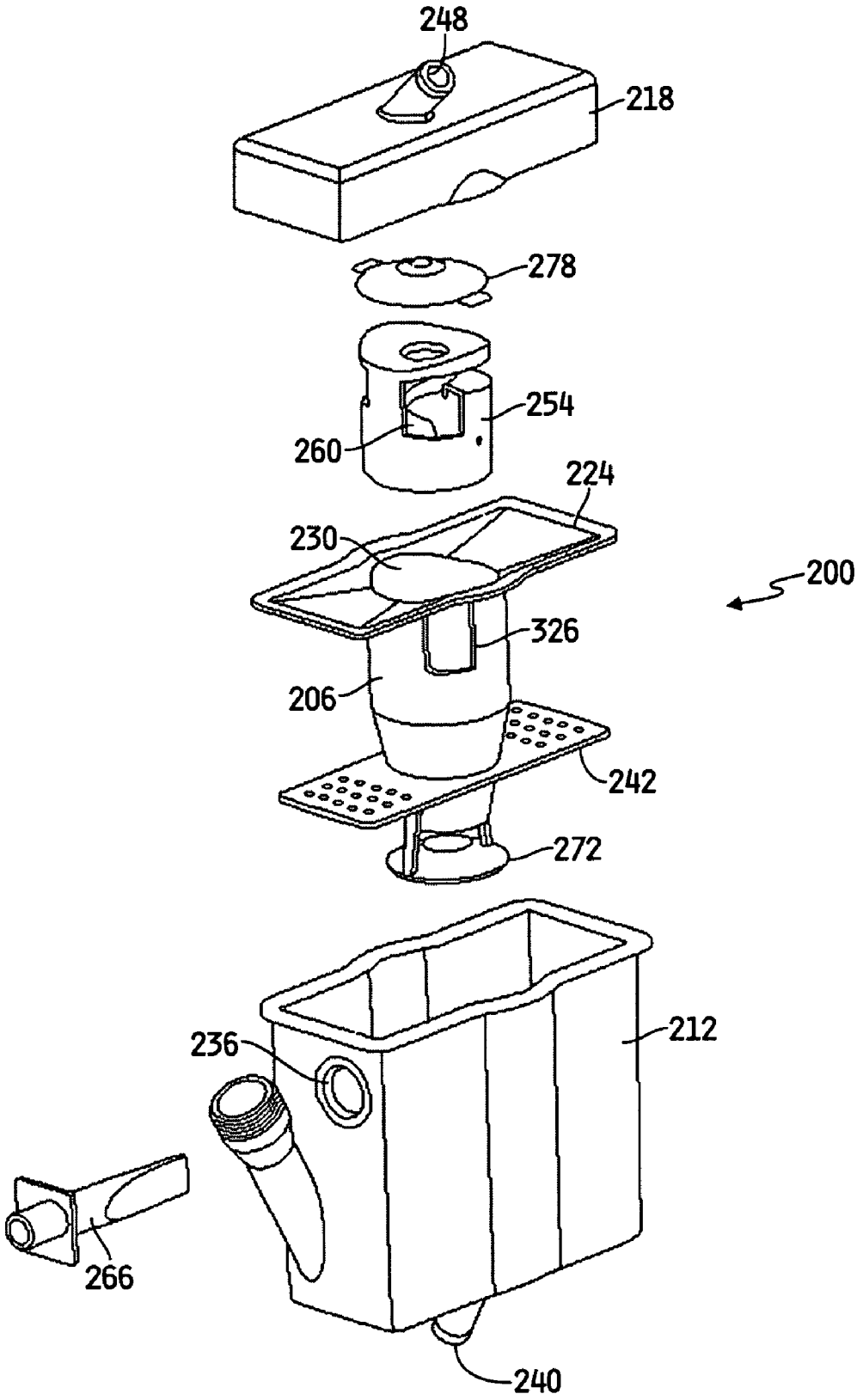
FIG. 7 shows an exploded perspective view of an integrated liquid reservoir and separator in accordance with an embodiment of the invention.

As shown in FIGS. 6 and 7, some embodiments of the liquid reservoir 200 include a liquid chamber 212 and a gas chamber 218. In some embodiments, the liquid chamber 212 and gas chamber 218 are separated by a main baffle 224 which may have a communication orifice 230 between the two chambers. The liquid chamber 212 may house the separator 206, include a liquid and gas inlet orifice 236 and a liquid outlet 240, and house a turbulence baffle 242. The gas chamber 218 may include a gas vent 248. In some embodiments, the separator 206 includes a deflector 254, a guiding member 260 within the deflector, and be adapted to receive a liquid and gas inlet nozzle 266. As shown in FIGS. 6 and 7, a liquid inhibiting member 272 may be provided proximate the liquid outlet 240 inside the liquid chamber 212 and a gas inhibiting member 278 may be provided proximate the communication orifice 230 between the two chambers 212, 218. These components may be properly assembled by any suitable means (e.g., rivets, welds, bolts, snaps, and/or clips).

Figure 9:
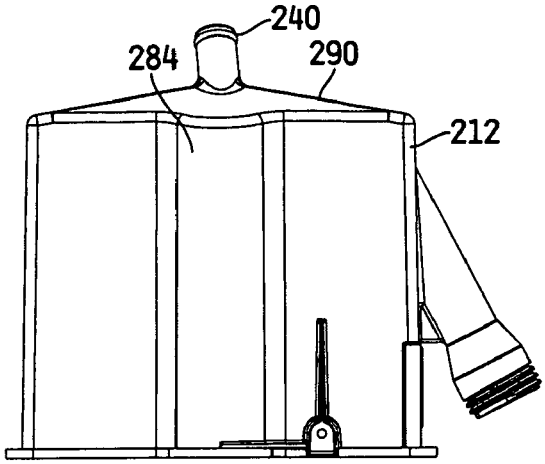
FIG. 9(*a*) shows a side plan view of a liquid chamber in accordance with an embodiment of the invention.
Figure 9:
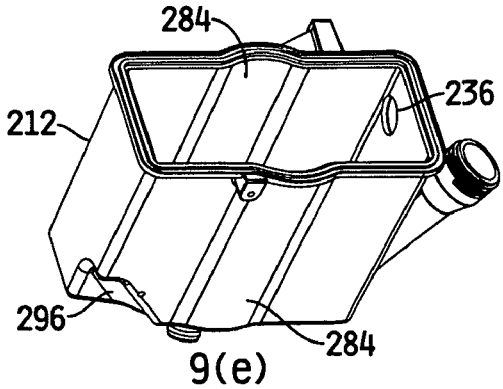
Figure 9:
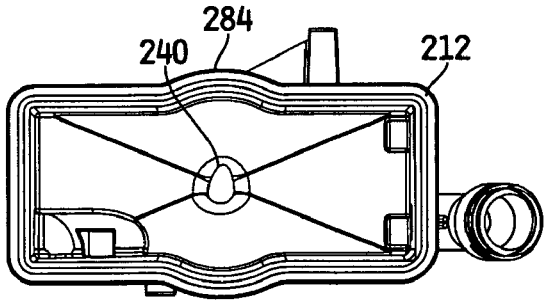
Figure 9:
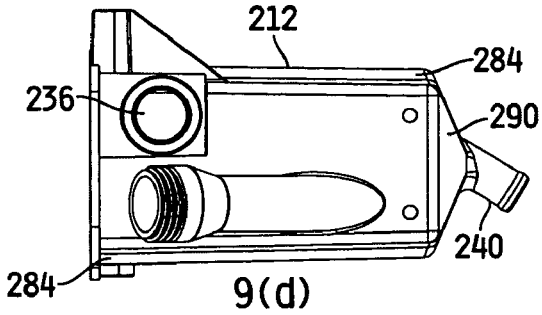
Figure 9:
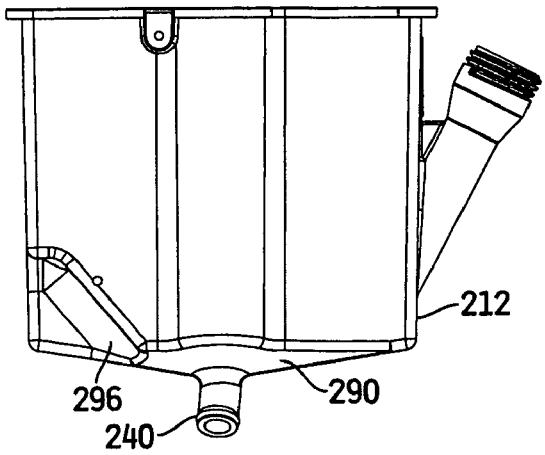

An embodiment of the liquid chamber 212 is shown in FIGS. 6, 7, and 9(*a*)-(*e*). Liquid chamber 212 may be of any shape or form useful for holding liquid (e.g., oil). As shown, some embodiments are useful for achieving desirable operational angles. For example, some embodiments of the liquid chamber 212 include a rectangular cross section with bulges 284 centrally located on two opposite sides. In some embodiments, this configuration is similar to a circle overlaid on a rectangle. The cross section of the liquid chamber 212 may be constant from a sump 290 (e.g., a tapered bottom to aid in draining) to the main baffle 224. Of course, some dents 296 may be included within this cross-section to clear various engine or chassis components. Although the size of the liquid chamber 212 will depend on the application, in one embodiment, for example, the liquid chamber may be about 7.5 inches high, about 8.5 inches long, and about 3.2 inches wide.

As shown in FIG. 9(*d*), the liquid chamber may also include a liquid and gas inlet orifice 236 to allow for the introduction of liquid and gas into the liquid reservoir 200. As shown in FIGS. 9(*a*)-(*e*), the liquid chamber 212 may also include a liquid outlet 240. In some embodiments, liquid outlet 240 is disposed generally to include the center of a horizontal cross section of the liquid reservoir 200. The horizontal cross section of the liquid reservoir 200 may be defined as any plane generally parallel to surface A of baffle 242 in FIG. 6. Such embodiments are useful for achieving desirable operational angles.

Figure 10:
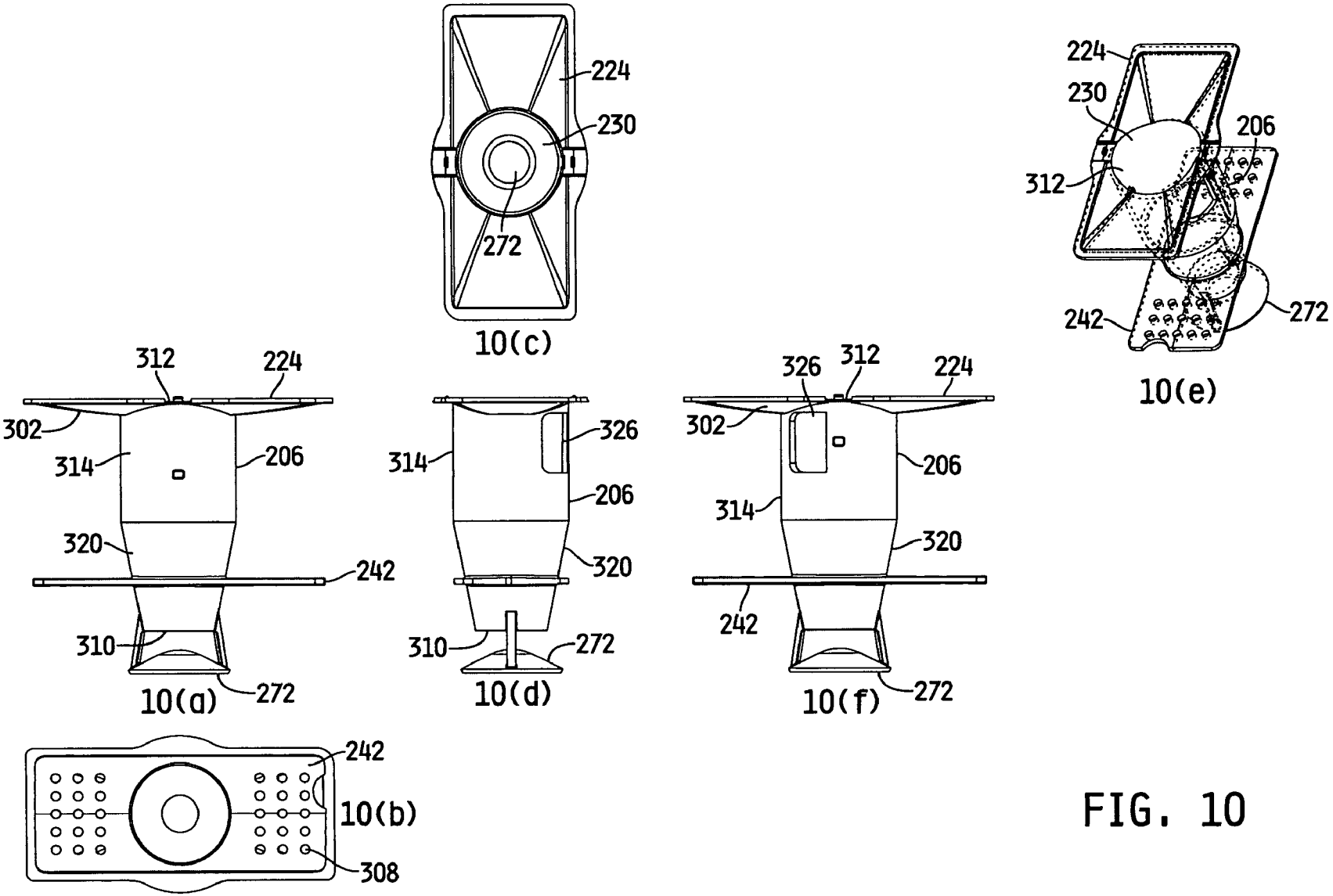
FIG. 10(*a*) shows a side plan view of a separator in accordance with an embodiment of the invention.
Figure 11:
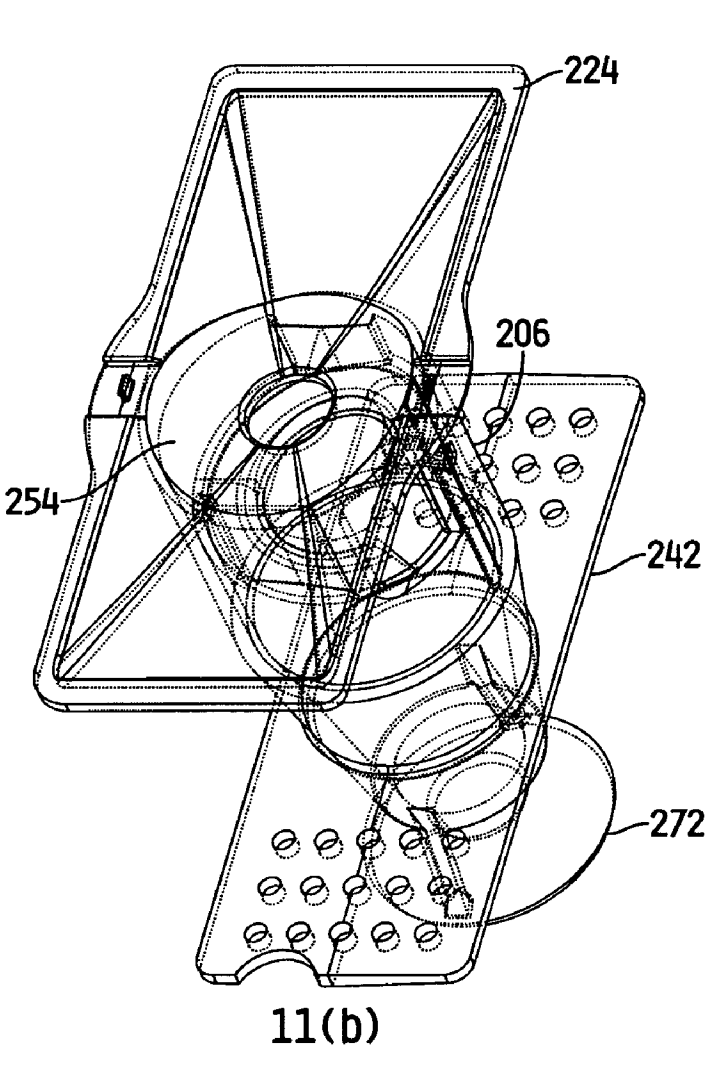
FIG. 11(*a*) shows an expanded perspective view of a separator and deflector in accordance with an embodiment of the invention.
Figure 11:
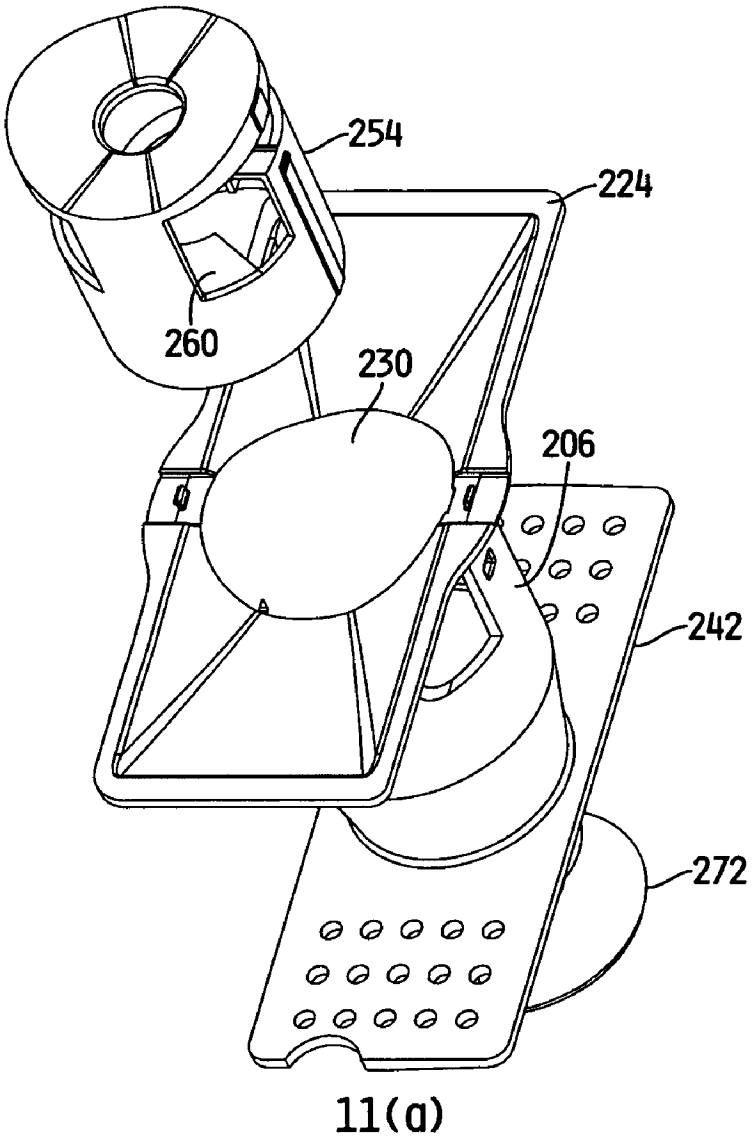

Further, as described below, some embodiments include a separator 206 that is generally located to include the center of the horizontal cross section of the liquid chamber 212. In such embodiments, liquid inhibiting member 272 may be provided to protect the liquid outlet from ingesting any gas pockets expelled from the exit of the separator 206, as shown in FIGS. 6, 7 and 10(*a*),(*c*), (*d*),(*e*),(*f*) and 11(*a*)-(*b*). The liquid inhibiting member 272 may be of any shape, such as a dome, useful for redirecting liquid exiting separator 206 laterally into the liquid volume located within the liquid reservoir 212. This action allows any gas pockets to be transported to the peripheral edges of the liquid volume where the suction from the liquid outlet is less severe, and therefore allows the gas pockets to naturally rise to the liquid volume surface.

Figure 8:
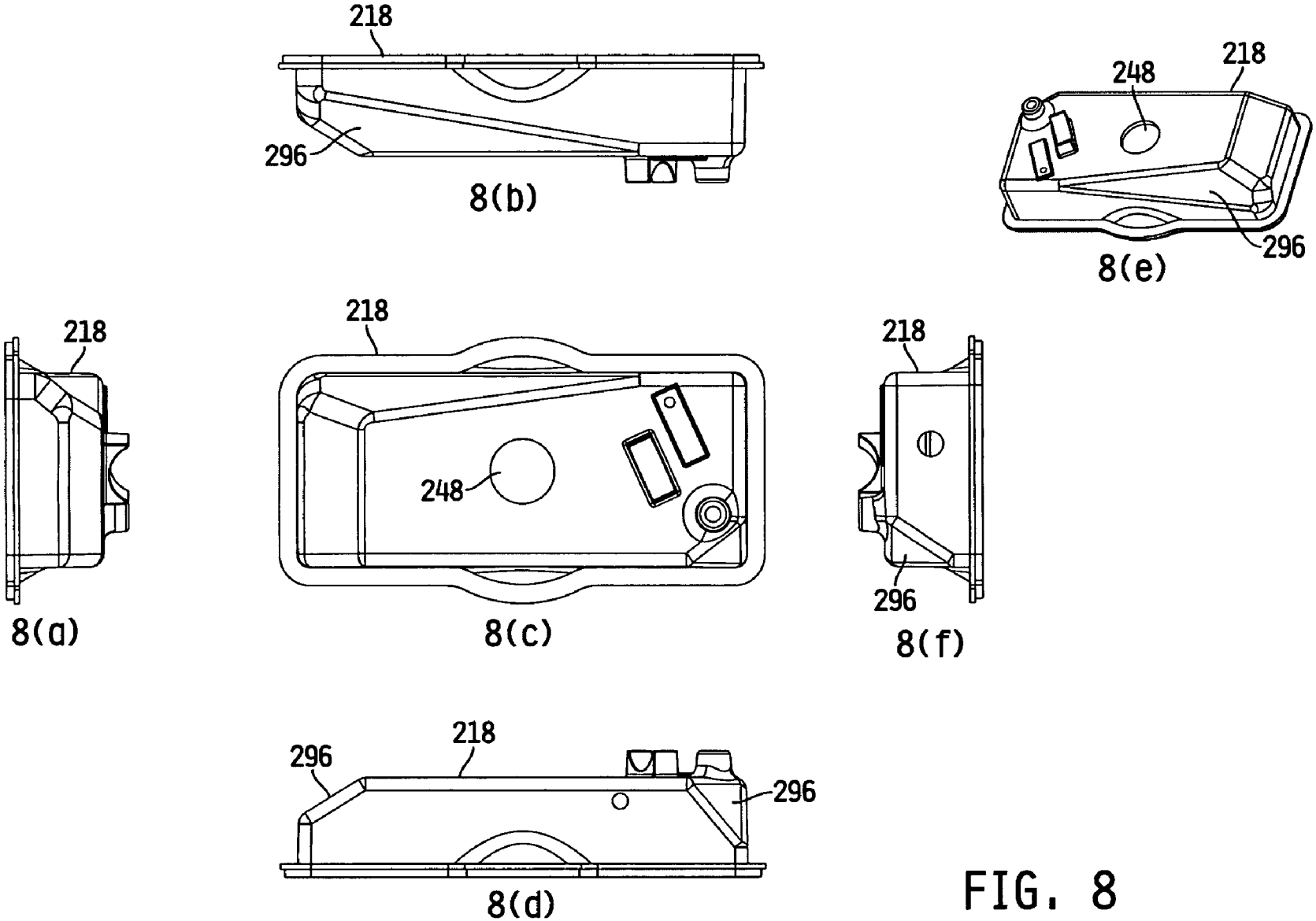
FIG. 8(*a*) shows a front plan view of a gas chamber in accordance with an embodiment of the invention.

An embodiment of a gas chamber 218 is shown in FIGS. 6, 7, and 8(*a*)-(*f*). The gas chamber 218 may be useful for acting as a buffer to decrease the gas velocity through the gas vent 248. Further, the gas chamber 218 may be useful for allowing the liquid reservoir 200 to properly vent with part of the gas chamber (e.g., half) full of liquid without venting liquid with the gas. As shown in FIGS. 8(*c*) and (*e*), the gas vent 248 may be generally located to include the center of the horizontal cross-section of the gas chamber 218. Although the gas chamber 218 may be generally symmetric in two axes, some non-symmetrical features may be provided, such as dent 296, to clear engine or chassis components. If one or more dents 296 is provided, it may be desirable that they be placed near the front of the gas chamber 218, as this location primarily affects operating angles on descent where desired angles are generally easier to achieve without discharging liquid with the gas. Although the size of the gas chamber 218 will depend on the application, in one embodiment, for example, the gas chamber may be about 1.3 inches high, about 8.5 inches long, and about 3.2 inches wide.

Figure 14:
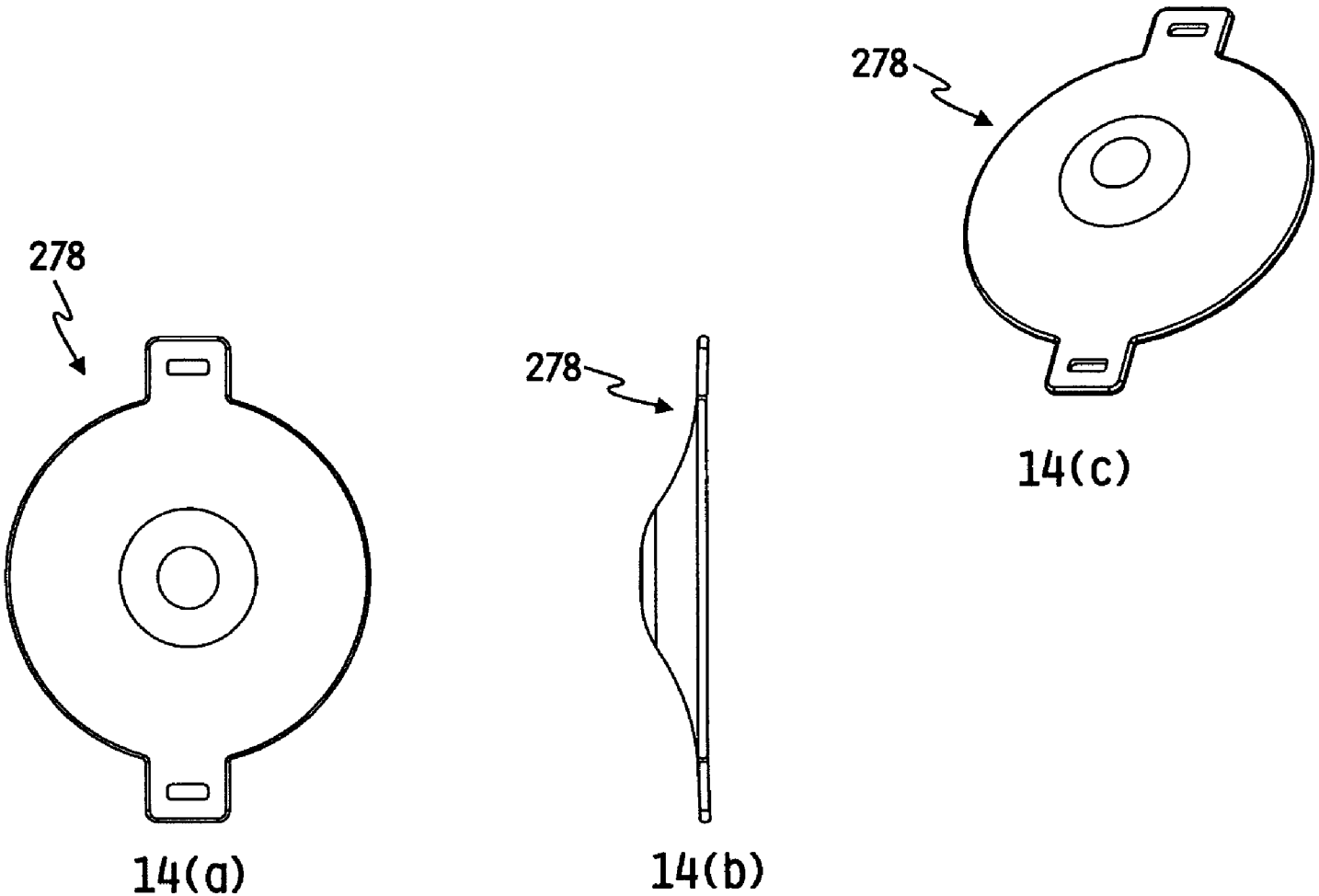
FIG. 14(*a*) shows a top plan view of an inhibiting member in accordance with an embodiment of the invention.

In some embodiments, a gas inhibiting member 278 is provided to cover the communication orifice 230 between the gas chamber 218 and the liquid chamber 212, as shown in FIGS. 6, 7, and 14(*a*)-(*c*). The gas inhibiting member 278 may be of any shape, such as a dome, useful for preventing liquid spray carried by the venting gas from being carried directly into the gas vent 248. In some embodiments, the profile of the gas inhibiting member 278 may allow a smooth transition for the gas making its way into the gas chamber 218, but force liquid droplets to bounce off the underside of the gas inhibiting member 278 and fall into the liquid chamber 212. In some embodiments, the top side of the inhibiting member is designed to allow any liquid that gets into the gas vent 248 to fall onto the top of the gas inhibiting member 278 and drip onto the main baffle 224.

The gas inhibiting member 278 may also be useful to increase the effective damping effect of the gas chamber 218. That is, rather than allowing the gas to travel directly to the gas vent 248 from the communication orifice 230, gas inhibiting member 278 may provide an obstruction. Generally, the damping effect of the gas chamber 218 is directly related to the height of the gas chamber 218. However, the height of the gas chamber 218 usually cannot be maximized due to space constraints within the engine compartment. In some embodiments, the gas inhibiting member 278 directs the gas to travel around and through part of the rest of the gas chamber 218. In such embodiments, the damping effect is increased due to the longer path of travel of the gas before it is vented. This damping effect minimizes large peak velocities (pulses) of the venting gas to create a more constant, lower velocity venting. Further, the damping reduces the volume of liquid carried with the venting gas.

The liquid reservoir 200 may include a main baffle 224, as shown in FIGS. 6, 7, 10(*a*),(*c*), (*f*), (*e*) and 11 (*a*)-(*b*). Main baffle 224 may be useful for separating the gas chamber 218 from the liquid chamber 212. In some embodiments, the main baffle 224 includes a shallow sump 302 to encourage drainage of any liquid from the gas chamber 218 into the liquid chamber 212. In some embodiments, communication orifice 230 passes through the main baffle 224. In such embodiments, the surface of the main baffle 224 may be tapered down toward the communication orifice 230 to promote drainage and minimize any liquid present on top of the main baffle 224.

The liquid reservoir 200 may also include a turbulence baffle 242. The turbulence baffle 242 may be of any size or shape useful for quieting the turbulence in the liquid volume. Reducing turbulence within the liquid volume serves to maintain a constant liquid supply to the liquid outlet when the reservoir is subjected to violent accelerations (e.g., such as high-speed bumps or harsh landings). In some embodiments, turbulence baffle 242 is disposed within liquid chamber 212. As shown in FIGS. 6, 7, 10(*a*),(*b*),(*e*),(*f*), and 11 (*a*)-(*b*), the turbulence baffle 242 may be shaped to fit against the walls of the liquid chamber 212, thereby filling the horizontal cross-section of the liquid chamber 212. Turbulence baffle 242 may also be sized to fill or not fill the bulge 284 of liquid chambers 212, if so provided. In some embodiments, the turbulence baffle 242 may have a generally centrally located aperture to reduce the restriction on liquid leaving the separator 206 and to allow the separator 206 to pass through the turbulence baffle 242. The turbulence baffle 242 may also be provided with one or more apertures 308 adapted to allow the liquid to drain from one side of the turbulence baffle to the other.

A liquid and gas separator 206 may be disposed within the liquid reservoir 200. Separator 206 may include any feature useful for separating liquid (e.g. oil) and gas. In some embodiments, the separator 206 is generally located to include the center of the horizontal cross-section of the liquid reservoir 200. An embodiment of the separator 206 is shown in FIGS. 6, 7, 10 (*a*)-(*f*), and 11 (*a*)-(*b*). As shown, separator 206 may include a separator liquid outlet 310 adapted to allow liquid to exit the separator 206. In some embodiments, separator liquid outlet 310 may be generally disposed to include the center of a horizontal cross section of the liquid reservoir 200. Also as shown, separator 206 may have a separator gas outlet 312 adapted to allow gas to exit the separator 206. Separator gas outlet 312 may also be generally disposed to include the center of a horizontal cross section of the reservoir 200. Although the size of the separator 206 will depend on the application, in one embodiment, for example, the separator may be about 6 inches long and have a cylinder diameter of about 3.25 inches.

In some embodiments, the separator 206 includes a cylindrical section 314 that transitions into a conical section 320. In such embodiments, the cylindrical section 314 is useful to promote the liquid to travel across the inside peripheral face of the separator 206 to push gas out of the liquid by centrifugal force. The conical section 320 is useful for providing better liquid and gas separation by providing the gas with an upward velocity component. Further, the conical section 320 is useful for helping to recombine the circular liquid surface into a liquid stream for delivery into the liquid chamber 212 when exiting the bottom of the separator 206. During this recombination, the cone 320 may also force most of the gas up rather than down into the liquid volume. Generally, the more cone length that is added relative to cylinder length, the greater the restriction to incoming liquid and the poorer the venting characteristics of the reservoir. Although the length of the cylindrical section 314 and the conical section 320 will depend on the application, in one embodiment, for example, the cylindrical section may be about 3 inches long and the conical section may be about 3 inches long.

Some embodiments of the separator 206 incorporate a slot 326. Such a slot 326 may be useful for providing an opening for the inlet nozzle 266 to enter into the separator 206 as well as to allow communication between inside the separator 206 and any gas inside the liquid chamber 212 and to facilitate efficient liquid draining. The slot 326 may take any shape and be disposed in any location useful for promoting these functions. In some embodiments, the slot 326 is useful for providing a pressure relief for proper venting and to promote ease of draining while minimizing liquid entry into the gas chamber 218. In some embodiments, the location of the slot 326 may be proximate the main baffle 224 to limit liquid re-entry from the liquid chamber 212 into the separator 206. In some embodiments, the location of the slot 326 is proximate the front of the liquid chamber 212 to limit the amount of liquid droplets re-entering the separator 206. This position is useful because relatively less liquid is splashed when it is shifted to the front as most riders tend to use less throttle while going downhill than when going uphill. Further, in embodiments where the slot 326 is also adapted to receive the inlet nozzle 266, manufacturing ease will be increased as only one aperture is needed for both functions.

A deflector 254 may be provided within the separator 206. In some embodiments, the deflector is generally located to include the center of the horizontal cross-section of the liquid reservoir 200 to reduce the amount of gas bubbles entering the liquid outlet 240. In embodiments where the deflector 254 is generally centrally located above the liquid inhibiting member 272, the suction from the liquid outlet 240 is not directed at the outlet of the deflector 254. Therefore, in such embodiments, the gas pockets exiting the bottom of the deflector 254 may be dispersed into the peripheral edges of the liquid volume where they are less likely to exit liquid outlet 240. This feature allows the gas to rise to the surface of the liquid volume and be dispelled into the gas volume in the liquid chamber 212.

Figure 12:
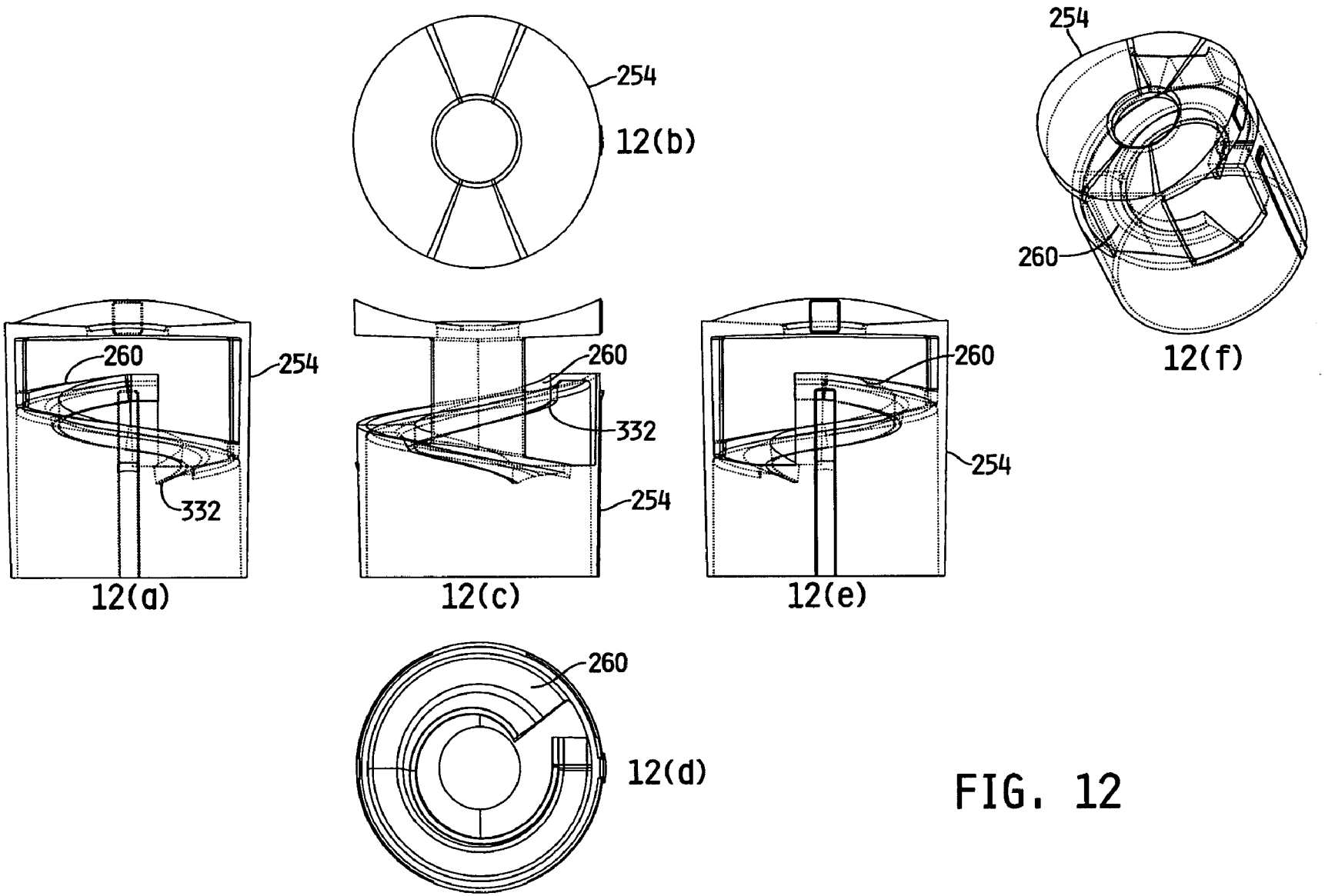
FIG. 12(*a*) shows a side plan view of a deflector in accordance with an embodiment of the invention.

In some embodiments, the deflector 254 includes a guiding member 260, as best shown in FIG. 12 (*a*),(*c*)-(*f*). Guiding member 260 may be any shape useful for guiding the incoming liquid downward in the deflector 254 (e.g., giving it a downward velocity component), such as a spiral ramp. Such an embodiment is useful for allowing the incoming liquid stream to circulate within the deflector 254, allowing more time and favorable surface area to volume conditions for the gas to separate from the liquid. Further, guiding member 260 may also be useful for quickly forcing the incoming liquid stream to drop in height within the deflector 254 to minimize interference with the incoming liquid. In some embodiments, the guiding member 260 includes a downward curled edge 332 on the profile of the spiral useful for retaining liquid against the wall of the deflector 254, thereby minimizing any liquid spray into the center of the separator's diameter, which reduces the amount of liquid carried up and into the gas chamber 218. In addition, some embodiments of the guiding member complete at least a 360° sweep. Such a sweep is also useful as a barrier for liquid splashes at extreme operational angles, which prevents some liquid from reaching the communication orifice 230. In some embodiments, the vertical translation of the guiding member is such that it moves the incoming liquid below the inlet before the liquid makes a complete revolution within the deflector 254.

Figure 13:
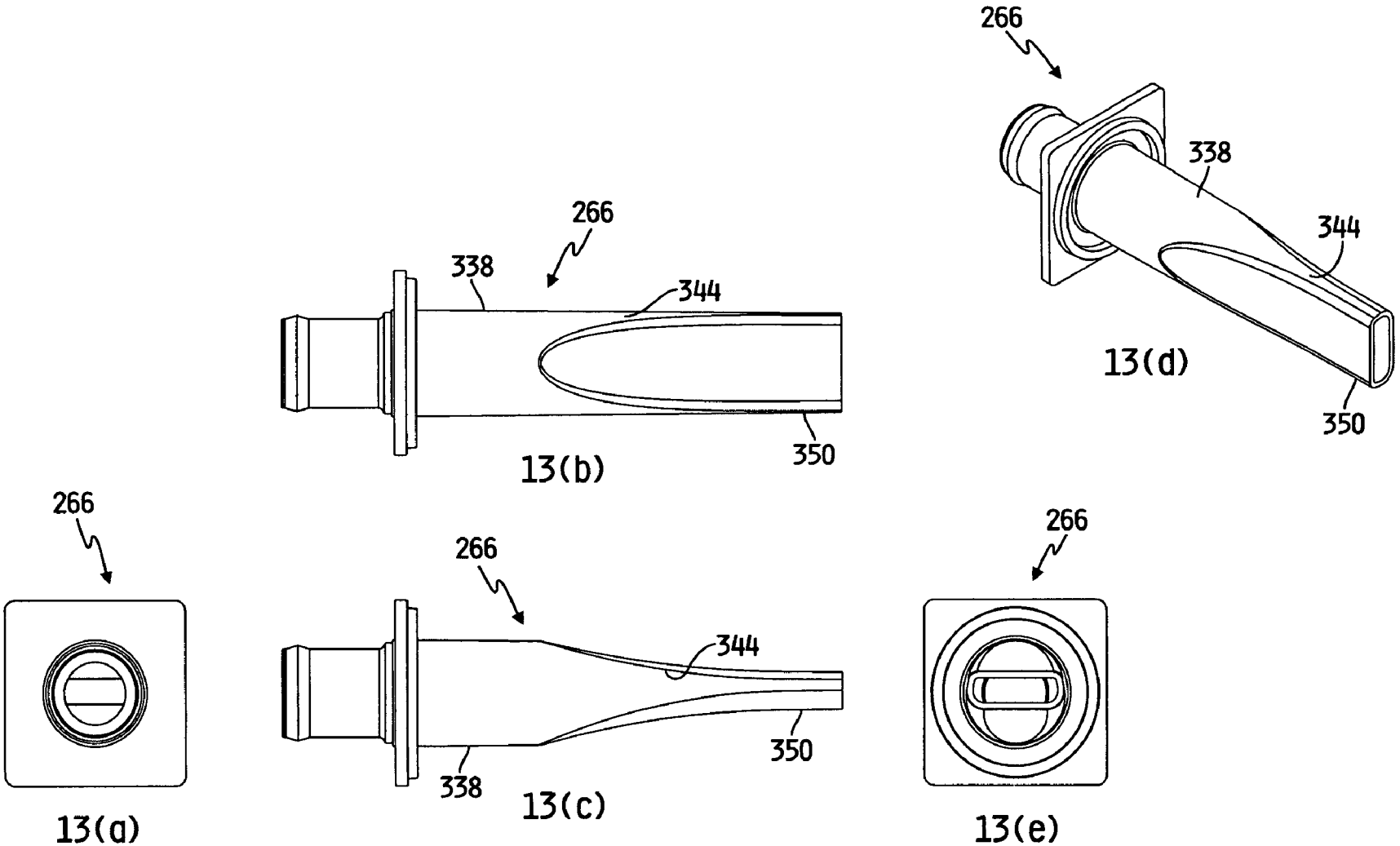
FIG. 13(*a*) shows a front plan view of an inlet nozzle in accordance with an embodiment of the invention.

An embodiment of a liquid and gas inlet nozzle 266 is shown in FIGS. 6, 7, and 13(*a*)-(*e*). In some embodiments, liquid and gas inlet nozzle 266 is positioned to deliver liquid and gas proximate the center of a horizontal cross section of the liquid reservoir 200. In such embodiments nozzle 266 may be positioned through slot 326. Further, in some embodiments, the liquid and gas inlet nozzle 266 delivers liquid and gas internal to the separator 206. Inlet nozzle 266 may be of any suitable shape and size to deliver liquid and gas into the liquid reservoir 200. In some embodiments, inlet nozzle 266 includes a circular cross-section portion 338, a smooth transitional portion 344, and a rectangular cross-section portion 350. The vertically oriented rectangular cross-section portion 350 is useful for promoting a fan of liquid across the peripheral face of the deflector. This feature facilitates in keeping the liquid against the side of the deflector and reduces spray-back relative to nozzles discharging from a circular cross-section. Further, there may be a smooth transition portion 344 from the circular cross-section portion 338 to the rectangular cross-section portion 350 to facilitate laminar flow. In some embodiments, the inlet nozzle 266 is oriented tangential and adjacent to the peripheral face of the inside of the deflector to encourage a smooth transition of the flow from the inlet nozzle into the deflector and along the deflector's inside wall. In some embodiments, the liquid and gas inlet nozzle 266 is adapted to deliver the incoming liquid and gas in a manner to create a fan pattern across an internal wall of the separator 206. The deflector 254 and/or guiding member 260 can be a separate component from the separator 206 or may be integrally formed with it as a single unit.

Integrated liquid separators and reservoirs as described above are useful for allowing a vehicle to operate at extreme angles without venting significant amounts of liquid through the gas vent 248 or allowing significant amounts of gas to be sucked out the liquid outlet 240. Significant amounts may be defined as the presence of relatively larger gas bubbles passing though the liquid outlet or relatively large amounts of liquid passing through the gas outlet. For example, during ascent some embodiments may operate at least about 80° at full load/wide open throttle (WOT) for about 2 seconds, and some embodiments may operate at least about 60° at full load for about 3 minutes. Some embodiments may also operate above about 70° at idle for about 10 minutes. During descent, some embodiments may operate above about 60° with clutch engagement for about 10 minutes, and at idle operate indefinitely. At right or left angles, some embodiments may operate above about 60° at full load for about 5 seconds, and above about 50° for about 3 minutes.

Such an integrated liquid separator and reservoir is adapted to reduce venting liquid with the gas, even at relatively extreme operation angles. Further, such a system is adapted to save space within the engine compartment and allows for greater flexibility in place engine components. Such a system solves the dynamics involved with separating liquid and gas that are introduced into a relatively large volume of liquid, as well as providing a constant supply of liquid to the outlet from a relatively large liquid volume.

The following example is presented for illustrative purposes only and is not intended to limit the scope of the claims that follow.

EXAMPLE 1

Operational Angles Achieved by an Embodiment of an Integrated Liquid Reservoir and Separator An embodiment of the integrated liquid reservoir and separator was tested on a four-cycle dry sump engine to determine maximum operation angles at certain time intervals. The results are presented in Table 1.

TABLE 1

Operation Angles by Time and Operating Condition

| | Engine Condition | Time |
|---|---|---|
| Ascent | | |
| 82° | full load/WOT | 2 seconds |
| 65° | full load/WOT | 3 minutes |
| 75° | idle | 10 minutes |
| Descent | | |
| 65° | clutch engagement | 10 minutes |
| 65° | idle | indefinitely |
| Right/Left | | |
| 65° | full load/WOT | 5 seconds |
| 60° | full load/WOT | 3 minutes |

Thus, embodiments of the Integrated Liquid-Gas Separator and Reservoir are disclosed. One skilled in the art will appreciate that the present invention can be practiced with embodiments other than those disclosed. The disclosed embodiments are presented for purposes of illustration and not limitation, and the present invention is limited only by the claims that follow.

What is claimed is:

1. A vehicle comprising:

a chassis, an engine supported by the chassis, the engine coupled to a drive train useful for propelling the vehicle, and a seat supported by the chassis;

a liquid reservoir separate from the engine;

a separator useful for separating liquid and gas generally disposed to include the center of a horizontal cross section of the liquid reservoir, the separator including a liquid and gas inlet receiving liquid and gas mixture from the engine and a liquid outlet positioned below the liquid and gas inlet to release liquid from an interior region of the separator; and a liquid and gas inlet nozzle extending from the liquid reservoir to the separator to direct liquid and gas toward the separator.

2. The vehicle of claim 1, wherein the liquid reservoir includes a gas chamber and a liquid chamber separated by a main baffle.

3. The vehicle of claim 2, wherein the liquid chamber includes a turbulence baffle.

4. The vehicle of claim 1, wherein the liquid reservoir includes a liquid outlet generally disposed to include the center of a horizontal cross section of the liquid reservoir and a liquid inhibiting member positioned proximate the liquid outlet.

5. The vehicle of claim 1, wherein the liquid reservoir includes a gas outlet generally disposed to include the center of a horizontal cross section of the liquid reservoir and a gas inhibiting member positioned proximate the gas outlet.

6. The vehicle of claim 1, wherein the separator includes a deflector having a guiding member positioned to guide incoming liquid downward.

7. The vehicle of claim 6, wherein the guiding member includes a spiral ramp.

8. The vehicle of claim 1, wherein the engine is a four stroke engine having a scavenge ratio of about point one to one to about ten to one and the vehicle is selected from the group consisting of snowmobiles, personal watercraft, all terrain vehicles, and utility vehicles.

9. The vehicle of claim 1, wherein the liquid includes oil and the vehicle is adapted to operate at one or more of the following conditions without venting significant amounts of gas through a liquid outlet disposed within the liquid reservoir: at least about eighty degrees ascent at full load for about two seconds, at least about sixty degrees ascent at full load for about three minutes, at least about seventy degrees ascent at idle for about ten minutes, at least about sixty degrees descent with clutch engagement for about ten minutes, at least about sixty degrees right or left at full load for about five seconds, and at least about fifty degrees right or left at full load for about three minutes.

10. The vehicle of claim 1, wherein the liquid and gas inlet nozzle is adapted to deliver the incoming liquid and gas in a manner to create a fan pattern across an internal wall of the separator.

11. The vehicle of claim 1, wherein the liquid reservoir includes an inner surface defining an interior volume and the separator is positioned in the interior volume and includes an outer-most surface defining a maximum width of the separator, the outer-most surface is spaced apart from the inner surface of the liquid reservoir.

12. The vehicle of claim 1, wherein the liquid reservoir has an interior height and the separator extends a majority of the interior height.

13. The vehicle of claim 1, wherein the reservoir includes an liquid and gas inlet, a gas outlet, and a liquid outlet positioned below the gas outlet of the reservoir.

14. The vehicle of claim 1, wherein the liquid reservoir includes a wall defining a liquid and gas inlet spaced apart from the liquid and gas inlet of the separator.

15. The vehicle of claim 14, further comprising a tube extending between the liquid and gas inlet of the liquid reservoir and the liquid and gas inlet of the separator.

16. A vehicle comprising:

a chassis, an engine supported by the chassis, the engine coupled to a drive train useful for propelling the vehicle, and a seat supported by the chassis;

a liquid reservoir separate from the engine; and a separator useful for separating liquid and gas disposed within the liquid reservoir, the separator including an outer wall and a deflector having a guiding member extending inward from the outer wall and positioned to guide incoming liquid downward, the separator having a longitudinal axis, the guiding member including a ramped surface that is inclined relative to the longitudinal axis.

17. The vehicle of claim 16, wherein the liquid reservoir includes a gas chamber and a liquid chamber separated by a main baffle.

18. The vehicle of claim 17, wherein the liquid chamber includes a turbulence baffle.

19. The vehicle of claim 16, wherein the liquid reservoir includes a liquid outlet generally disposed to include the center of a horizontal cross section of the liquid reservoir and a liquid inhibiting member positioned proximate the liquid outlet.

20. The vehicle of claim 16, wherein the liquid reservoir includes a gas outlet generally disposed to include the center of a horizontal cross section of the liquid reservoir and a gas inhibiting member positioned proximate the gas outlet.

21. The vehicle of claim 16, the separator being generally disposed to include the center of a horizontal cross section of the liquid reservoir.

22. The vehicle of claim 16, wherein the engine is a four stroke engine having a scavenge ratio of about point one to one to about ten to one and the vehicle is selected from the group consisting of snowmobiles, personal watercraft, all terrain vehicles, and utility vehicles.

23. The vehicle of claim 16, wherein the guiding member includes a spiral ramp.

24. The vehicle of claim 16, further comprising a liquid and gas inlet nozzle having a longitudinal axis extending through the separator.

25. The vehicle of claim 23, wherein the liquid and gas inlet nozzle is adapted to deliver the incoming liquid and gas in a manner to create a fan pattern across an internal wall of the separator.

26. The vehicle of claim 16, wherein the liquid reservoir including an inner surface defining an interior volume and the guiding member is positioned so that a substantial portion of the incoming fluid first comes into contact with the guiding member.

27. A vehicle comprising:

a chassis, an engine supported by the chassis, the engine coupled to a drive train useful for propelling the vehicle, and a seat supported by the chassis;

a liquid reservoir separate from the engine; and a separator disposed within the liquid reservoir, the separator being useful for separating liquid and gas and having an interior region, a liquid and gas inlet receiving a liquid and gas mixture from the engine and introducing the liquid and gas mixture into the interior region, a separator gas outlet positioned to release gas from the interior region of the separator, and a separator liquid outlet generally disposed to include the center of a horizontal cross section of the liquid reservoir, wherein the liquid reservoir includes a wall defining a liquid and gas inlet spaced apart from liquid and gas inlet of the separator.

28. The vehicle of claim 27, wherein the separator gas outlet generally disposed to include the center of a horizontal cross section of the liquid reservoir.

29. The vehicle of claim 27, wherein the separator is generally disposed to include the center of a horizontal cross section of the liquid reservoir.

30. The vehicle of claim 27, wherein the separator includes a deflector having a guiding member positioned to guide incoming liquid downward.

31. The vehicle of claim 30, wherein the guiding member includes a spiral ramp.

32. The vehicle of claim 27, further comprising a liquid and gas inlet nozzle extending through the liquid and gas inlet.

33. The vehicle of claim 32, wherein the liquid and gas inlet nozzle is adapted to deliver the incoming liquid and gas in a manner to create a fan pattern across an internal wall of the separator.

34. The vehicle of claim 27, further comprising a baffle, wherein the separator extends through the baffle.

35. The vehicle of claim 27, wherein the liquid and gas inlet of the separator is positioned in a vertical wall of the separator.

36. A vehicle comprising:

a chassis, an engine supported by the chassis, the engine coupled to a drive train useful for propelling the vehicle, and a seat supported by the chassis;

a liquid reservoir separate from the engine;

a separator disposed within the liquid reservoir; and a liquid and gas inlet nozzle positioned to direct liquid and gas toward an interior region defined within the separator.

37. The vehicle of claim 36, wherein the separator is generally disposed to include the center of a horizontal cross section of the liquid reservoir.

38. The vehicle of claim 37, wherein the separator includes a separator gas outlet and a separator liquid outlet generally disposed to include the center of a horizontal cross section of the liquid reservoir.

39. The vehicle of claim 36, wherein the separator includes a deflector having a guiding member positioned to guide incoming liquid downward.

40. The vehicle of claim 39, wherein the guiding member includes a spiral ramp.

41. The vehicle of claim 36, wherein the liquid and gas inlet nozzle is adapted to deliver the incoming liquid and gas in a manner to create a fan pattern across an internal wall of the separator.

42. The vehicle of claim 36, wherein the separator is positioned between an exit of the liquid and gas nozzle and an inner surface of the liquid reservoir that defines an interior volume, the separator is positioned within the interior volume.

43. The vehicle of claim 36, wherein the inlet nozzle defines an enclosed path from an inner surface of the liquid reservoir to the separator.

44. The vehicle of claim 36, wherein the inlet nozzle contacts the separator.

45. The vehicle of claim 36, wherein the liquid and gas nozzle includes an outlet having a width and a height substantially less than the width.

46. A vehicle comprising:

a chassis, an engine supported by the chassis, the engine coupled to a drive train useful for propelling the vehicle, and a seat supported by the chassis;

a liquid reservoir separate from the engine and defining an inner surface defining an interior region;

a separator disposed within the liquid reservoir and including an interior region; and a liquid and gas inlet nozzle extending between the inner surface of the liquid reservoir and the separator to deliver liquid and gas to the interior region of the separator.

47. The vehicle of claim 46, wherein the separator is generally disposed to include the center of the horizontal cross section of the liquid reservoir.

48. The vehicle of claim 46, wherein the separator includes a deflector having a guiding member positioned to guide incoming liquid downward.

49. The vehicle of claim 48, wherein the guiding member includes a spiral ramp.

50. The vehicle of claim 46, wherein the liquid and gas inlet nozzle extends through the inner surface of the liquid reservoir and into the interior region of the separator.

51. The vehicle of claim 50, wherein the liquid and gas inlet nozzle is adapted to deliver the incoming liquid and gas in a manner to create a fan pattern across an internal wall of the separator.

52. The vehicle of claim 46, wherein the liquid includes oil and the vehicle is adapted to operate at one or more of the following conditions without venting significant amounts of gas through a liquid outlet disposed within the liquid reservoir: at least about eighty degrees ascent at full load for about two seconds, at least about sixty degrees ascent at full load for about three minutes, at least about seventy degrees ascent at idle for about ten minutes, at least about sixty degrees descent with clutch engagement for about ten minutes, at least about sixty degrees right or left at full load for about five seconds, and at least about fifty degrees right or left at full load for about three minutes.

53. The vehicle of claim 46, wherein the inlet nozzle has a longitudinal axis extending through the separator.

54. A vehicle comprising:

a chassis, an engine supported by the chassis, the engine coupled to a drive train useful for propelling the vehicle, and a seat supported by the chassis;

a liquid reservoir separate from the engine;

a separator useful for separating liquid and gas generally disposed to include the center of a horizontal cross section of the liquid reservoir, the separator including a liquid and gas inlet receiving liquid and gas mixture from the engine and a liquid outlet positioned below the liquid and gas inlet to release liquid from an interior region of the separator, wherein the liquid reservoir includes a wall defining a liquid and gas inlet spaced apart from liquid and gas inlet of the separator.

55. The vehicle of claim 54, wherein the liquid reservoir includes a gas chamber and a liquid chamber separated by a main baffle.

56. The vehicle of claim 54, wherein the separator includes a deflector having a guiding member positioned to guide incoming liquid downward.

57. A vehicle comprising:

a chassis, an engine supported by the chassis, the engine coupled to a drive train useful for propelling the vehicle, and a seat supported by the chassis;

a liquid reservoir separate from the engine;

a separator disposed within the liquid reservoir, the separator being useful for separating liquid and gas and having an interior region, a liquid and gas inlet receiving a liquid and gas mixture from the engine and introducing the liquid and gas mixture into the interior region, a separator gas outlet positioned to release gas from the interior region of the separator, and a separator liquid outlet generally disposed to include the center of a horizontal cross section of the liquid reservoir; and a baffle, wherein the separator extends through the baffle.

58. The vehicle of claim 57, wherein the separator includes a deflector having a guiding member positioned to guide incoming liquid downward.

59. The vehicle of claim 58, wherein the guiding member includes a spiral ramp.

60. A vehicle comprising:

a chassis, an engine supported by the chassis, the engine coupled to a drive train useful for propelling the vehicle, and a seat supported by the chassis;

a liquid reservoir separate from the engine; and a separator disposed within the liquid reservoir, the separator being useful for separating liquid and gas and having an interior region, a liquid and gas inlet receiving a liquid and gas mixture from the engine and introducing the liquid and gas mixture into the interior region, a separator gas outlet positioned to release gas from the interior region of the separator, and a separator liquid outlet generally disposed to include the center of a horizontal cross section of the liquid reservoir, wherein the liquid and gas inlet of the separator is positioned in a vertical wall of the separator.

61. The vehicle of claim 60, further comprising a liquid and gas inlet nozzle extending through the liquid and gas inlet.

62. The vehicle of claim 61, wherein the liquid and gas inlet nozzle is adapted to deliver the incoming liquid and gas in a manner to create a fan pattern across an internal wall of the separator.

* * * * *